United States Patent [19]

Diehl

[11] 4,214,778

[45] Jul. 29, 1980

[54] HOLDDOWN MECHANISM FOR A TUBING HANGER IN A WELLHEAD

[75] Inventor: Robert J. Diehl, Vivian, La.

[73] Assignee: W-K-M Wellhead Systems, Inc., Shreveport, La.

[21] Appl. No.: 2,508

[22] Filed: Jan. 11, 1979

[51] Int. Cl.[2] ..... F16L 35/00

[52] U.S. Cl. ..... 285/39; 166/89; 285/143; 285/137 A; 285/404

[58] Field of Search ..... 285/39, 137 A, 139–148, 285/404, 86, 317, 308, 309, 321; 85/155; 151/69; 403/354, 362; 166/86, 89

[56] References Cited

U.S. PATENT DOCUMENTS

| | | | |
|---|---|---|---|
| 1,008,424 | 11/1911 | McKinney et al. | 85/1 SS |
| 1,965,907 | 7/1934 | Pierce | 285/143 X |
| 1,978,991 | 10/1934 | Dailey et al. | 285/139 X |
| 3,151,892 | 10/1964 | Word et al. | 285/141 X |
| 3,489,439 | 1/1970 | Word | 285/143 |
| 3,606,393 | 9/1971 | Huntsinger et al. | 285/321 X |
| 3,821,984 | 7/1974 | Lee | 166/86 X |
| 3,863,959 | 2/1975 | Blaschke | 151/69 X |

FOREIGN PATENT DOCUMENTS

| | | | |
|---|---|---|---|
| 1261414 | 4/1961 | France | 151/69 |

*Primary Examiner*—Dave W. Arola
*Attorney, Agent, or Firm*—Eugene N. Riddle

[57] ABSTRACT

A mechanism for releasably holding down a tubing hanger received within a hanger bowl of a wellhead. Pins mounted for axial sliding movement in horizontal passages of the hanger bowl are forced inwardly by screws which are threaded into passages of the wellhead and against heads formed on the outer ends of the pins. The pins have tapered inner ends which are forced into a groove of the tubing hanger and against a camming surface of the groove in order to press the tubing hanger downwardly within the hanger bowl. Each screw has a blade on its inner end which enters a slot in the head of the corresponding pin to rotate the pin as it is pushed against the camming surface of the groove. Springs urge the pins outwardly to facilitate entry of the blades into the slots, and retainer rings maintain the pins in their passages in the hanger bowl.

10 Claims, 2 Drawing Figures

74
78
80
76
88
86
82
62
72
96
98
100
94
92
90
162
152
168
164
166
160
158
148
154
150
156
120
16
12
118
128
132
130
134
124
136
122
126
138
140
144
142
146
3
3

HOLDDOWN MECHANISM FOR A TUBING HANGER IN A WELLHEAD

BACKGROUND OF THE INVENTION

This invention relates generally to wellheads and deals more particularly with a mechanism for holding down a tubing hanger in a unitized wellhead.

In a typical wellhead structure, one or more concentric casing strings are suspended from casing hangers which are supported within the bore of a single unitized head member. After the casing hangers have been properly situated, a hanger bowl is lowered into the wellhead to provide support for a tubing hanger which is usually considerably smaller in cross section than the bore of the wellhead, thus necessitating installation of the hanger bowl. The tubing hanger receives one or more tubing strings which extend down into the well within the innermost casing string.

The casing hangers are normally held down by a plurality of simple holddown screws which also act to energize pack-offs or other seal devices associated with the casing hangers. The holddown screws are threaded into the wellhead and against camming surfaces of the casing hangers or pack-off devices in order to urge these components downwardly. Holddown screws of this type may be used in a similar manner to hold down the tubing hanger of a more conventional type of wellhead, wherein the tubing hanger is mounted directly on a shoulder of a tubing head without an intermediate hanger bowl interposed between the hanger and the tubing head. However, in a unitized wellhead, the presence of the hanger bowl between the wellhead and the tubing hanger makes it impractical to employ simple screws to hold down the tubing hanger and activate its associated seal. In this instance, each screw must be run in a considerable distance through both the wellhead and the hanger bowl, requiring a rather long screw which is subjected to considerable axial stresses that tend to bend or otherwise deform and damage the screw. In addition, a difficult alignment problem is encountered because each passage of the hanger bowl must be precisely aligned with the corresponding passage of the wellhead in order for a single long screw to be run in successfully.

U.S. Pat. No. 3,489,439 to Word discloses one type of mechanism that is intended for use to hold down the tubing hanger of a wellhead. Although this arrangement avoids the problems associated with the use of simple holddown screws, it is less than satisfactory in a number of other respects, most notably in its cost and complexity. For example, the use of a camming ring or gland having a frusto-conical shape unduly complicates the structure and adds to the difficulties involved in fabricating and assembling the wellhead. Moreoever, three separate components must interact with one another in camming fashion which requires accurate dimensioning and precise machining of the parts if they are to cooperate with one another properly. The complicated arrangement of the components and their interaction with one another also detracts significantly from the reliability of the mechanism, particularly after extensive use and the accompanying wear to which the parts are subjected. Additional drawbacks include the lack of any positive means for retaining the inner pins properly in place during assembly of the wellhead and the lack of a positive release of the pins from the groove of the tubing hanger when the screws are backed off to permit lifting of the tubing strings.

SUMMARY OF THE INVENTION

The present invention has as its primary goal the provision of an improved mechanism for holding down the tubing hanger of a wellhead in a simple and effective manner. Another object of the invention is to provide a holddown mechanism that acts to firmly lock the tubing hanger in the proper position within its hanger bowl against even the highest pressures which tend to blow the tubing hanger upwardly. It is an additional object of the invention to provide a holddown mechanism of the character described which may be quickly and easily actuated and which may also be readily released to permit lifting of the tubing hanger and the associated tubing strings.

In accordance with the invention, slotted pins and threaded screws cooperate with one another to hold down a tubing hanger mounted within a hanger bowl of a unitized wellhead. Each pin is received in a passage in the hanger bowl, and each screw is threaded into a passage of the unitized wellhead in axial alignment with the corresponding pin. The screws may be threaded into the wellhead in order to push the pins inwardly into a groove formed on the tubing hanger. The pins have tapered inner ends which enter the groove and push downwardly against a camming surface of the groove in a manner to urge the tubing hanger downwardly. A blade on the inner end of each screw enters a slot in the head of the corresponding pin to impart rotation to the pin as it is pushed inwardly against the camming surface of the groove. When the screws are backed off to permit raising of the tubing hanger, the pins are positively withdrawn from the groove of the tubing hanger by springs but are maintained in the hanger bowl passages by retainer rings.

DETAILED DESCRIPTION OF THE INVENTION

In the accompanying drawings which form a part of the specification and are to be read in conjunction therewith:

Figure 1:
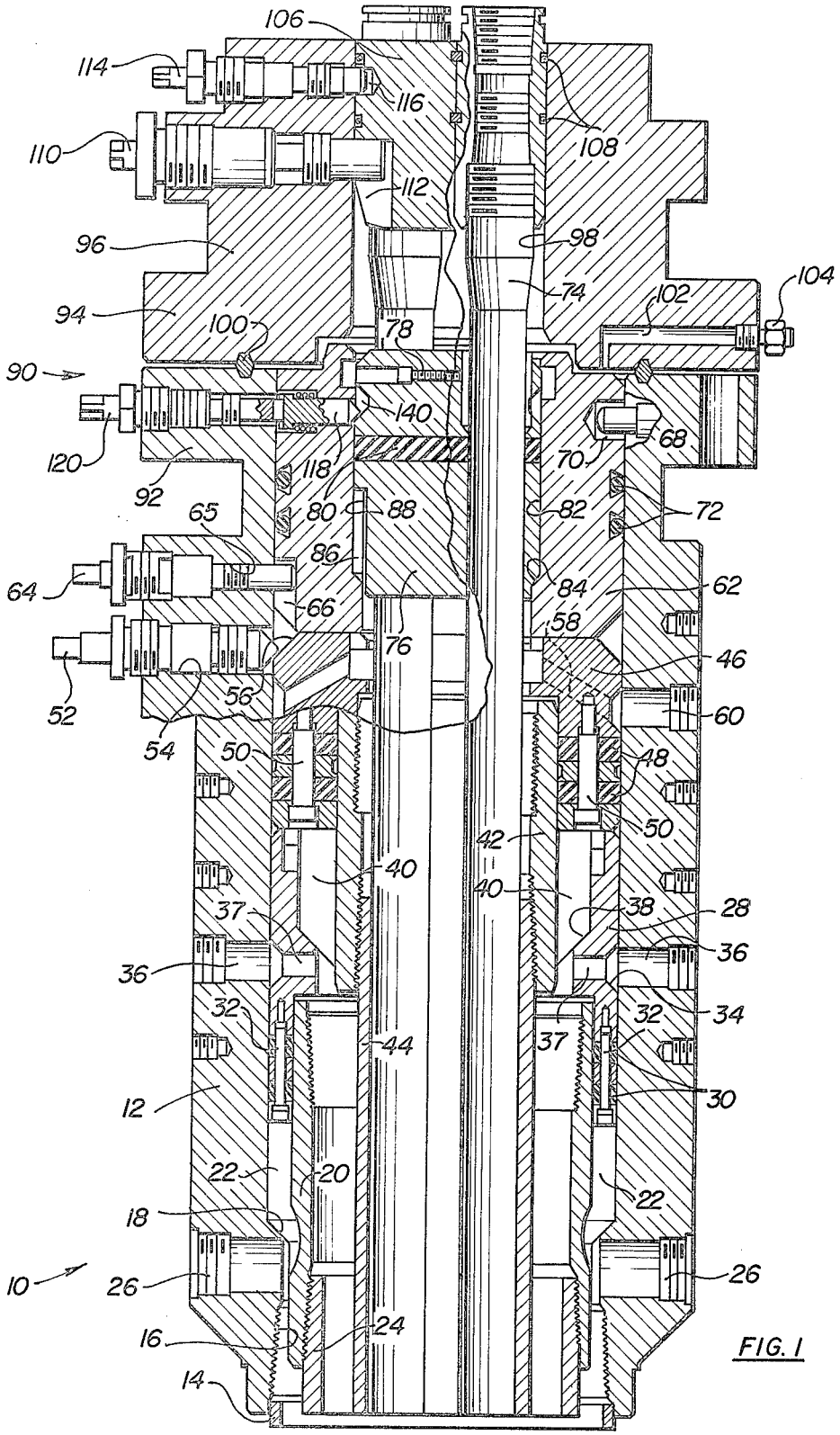
FIG. 1 is a sectional view taken on a vertical plane through a unitized wellhead assembly that includes a holddown mechanism constructed according to a preferred embodiment of the present invention, with portions broken away for purposes of illustration.

With initial reference to FIG. 1, numeral 10 generally designates a wellhead assembly which includes a unitized wellhead 12. An outer well casing 14 is connected in threaded fashion with the lower end of wellhead 12 in fluid communication with the lower portion of a central vertical bore 16 extending axially through the unitized wellhead. Bore 16 is cylindrical and is substantially uniform in size throughout the majority of its length. However, near the lower end of wellhead 12, bore 16 is reduced in diameter to present a frusto-conical shoulder 18 which faces generally upwardly to support the components of the wellhead assembly.

A mandrel hanger 20 has a flange portion 22 projecting outwardly from its outer surface. Flange portion 22 is adapted to seat on top of shoulder 18 to support mandrel hanger 20 thereon. The lower end of mandrel hanger 20 is internally threaded for connection with the top end of a casing string 24 which extends down into the well concentrically within the outer casing string 14. The top end of mandrel hanger 20 is internally threaded to receive a handling string (not shown) which may be used to lower the mandrel hanger into the wellhead 12. Passages 26 extend through wellhead 12 in fluid communication with the annulus presented between casing strings 14 and 24. As an alternative to mandrel hanger 20, conventional slips (not shown may be lowered onto shoulder 18 to grip casing 24 in a manner to suspend it from the wellhead.

An annular pack-off 28 is situated on top of the flange portion 22 of mandrel hanger 20. Pack-off 28 includes on its lower portion a pair of seal rings 30 which are located between mandrel hanger 20 and the wall of bore 16. The seal rings 30 are attached to the lower end portion of pack-off 28 by screws 32. Pack-off 28 has a frusto-conical shoulder 34 on its outside surface against which holddown screws (not shown) are threaded to energize seal rings 30 in a manner to tightly seal the annulus between mandrel hanger 20 and wellhead 12. Threaded passages 36 are formed in wellhead 12 in communication with passages 37 formed in pack-off 28. Passages 36 and 37 provide fluid communication between the exterior of the wellhead and the inside of casing 24.

The interior surface of pack-off 28 presents a frusto-conical shoulder 38 which faces generally upwardly and which receives a flange portion 40 projecting outwardly from an upper mandrel hanger 42. Mandrel hanger 42 is internally threaded at its bottom end in order to connect with the threaded top end of an inner casing string 44 which extends down into the well concentrically within casing strings 14 and 24. Mandrel hanger 42 is internally threaded at its top end in order to connect with a handling string (not shown). As an alternative to mandrel hanger 42, conventional slips (not shown) may be seated on shoulder 38 to grip casing 44 in order to suspend it from the wellhead.

A generally annular pack-off 46 is disposed on top of the lower pack-off 28 and flange portion 40. Pack-off 46 includes on its lower portion a pair of seal rings 48 which are attached by screws 50 and located between mandrel hanger 42 and the wall of bore 16. Holddown screws 52 may be threaded into passages 54 formed in wellhead 12 and may be tightened against a frusto-conical shoulder 56 formed on the outer surface of pack-off 46 at the top thereof. In this manner, screws 52 urge pack-off 46 downwardly to radially expand seals 48 tightly against the outer surface of mandrel hanger 42 and the wall of bore 16. A plurality of passages 58 extend through pack-off 46 and communicate with ports 60 formed in wellhead 12.

The generally flat top surface of pack-off 46 receives thereon an annular hanger bowl 62. Before bowl 62 is lowered onto the top of pack-off 46, a pair of alignment pins 64 are threaded into passages 65 formed in wellhead 12. Bowl 62 is lowered such that pins 64 are received in slots 66, thereby properly aligning bowl 62 with respect to its rotative position about the axis of wellhead 12. After bowl 62 has been lowered and aligned in this manner, lockdown pins 68 are threaded into wellhead 12 and into openings 70 formed in bowl 62. Pins 68 act to hold down bowl 62 against pressures tending to force it upwardly. The outside diameter of bowl 62 is substantially equal to or slightly less then the diameter of bore 16 such that the bowl fits rather closely within the bore of wellhead 12. A pair of O-rings 72 are carried in grooves on the outside surface of bowl 62 in order to provide seals between the bowl and wellhead.

Wellhead assembly 10 is suitable for use with a single completion well or a multiple completion well. For illustrative purposes, a dual completion well is shown having a pair of parallel tubing strings 74 extending downwardly alongside one another within the inner casing string 44. The two halves of a wraparound type tubing hanger 76 are wrapped around the respective tubing strings 74 and are bolted together by bolts 78. Tubing hanger 76 includes a seal 80 located slightly above the mid-point of the tubing hanger and adapted to seal against bowl 62 and tubing strings 74. The outside diameter of tubing hanger 76 is substantially equal to the diameter of a central vertical bore 82 formed axially through bowl 62. Near its lower end, bore 82 presents a frusto-conical shoulder 84 on which tubing hanger 76 seats. A pair of wedges 86 are welded to bowl 62 within its bore 82 and are sized to be closely received within narrow grooves 88 formed in the outside surface of tubing hanger 76. The fit between wedges 86 and grooves 88 properly aligns tubing hanger 76 with respect to its rotative position about the axis of bowl 62.

In accordance with the present invention, tubing hanger 76 is held down and its seal 80 is energized by a holddown mechanism which is generally designated by reference numeral 90 and which will subsequently be explained in detail with reference to FIGS. 2 and 3.

With continued reference to FIG. 1, wellhead 12 has at its top end an outwardly projecting flange 92 which is secured by bolts (not shown) to a lower flange 94 formed on the bottom of a tubing head attachment 96. The tubing head attachment 96 has a central vertical bore 98 which receives the top ends of the tubing strings 74. A gasket 100 provides a seal between flanges 92 and 94 at a location outside of bores 16 and 98. Flange 94 has a test port 102 which terminates at a location inside of gasket 100 in order to supply test fluid for testing of the seals of the wellhead assembly. A plug 104 normally closes passage 102.

A dual split tubing hanger 106 includes a pair of hanger halves which are connected in threaded fashion with the top ends of the tubing strings 74. The halves of the dual split tubing hanger 106 have seal rings 108 which seal the hanger halves to one another and to bore 98 of the tubing head attachment 96. Tubing hanger 106 is received within bore 98 and is aligned and supported therein by a pair of large diameter pins 110 which fit within V-shaped slots 112 formed in the outer surface of hanger 106 at the bottom thereof.

It should be noted that during assembly of the wellhead, tubing hanger 106 is connected with tubing strings 74 prior to the installation of tubing head attachment 96 on wellhead 12. Tubing hanger 106 is initially lowered and temporarily supported on top of the wraparound tubing hanger 76. Back pressure valves are then inserted and the BOP (not shown) is removed. Tubing head attachment 96 is bolted in place on wellhead 12 and tubing hanger 106 is lifted to a location well above the support pins 110. Pins 110 are threaded completely into attachment 96 until the pins in the position shown in FIG. 1 bottom out. Tubing head 106 is then lowered such that pins 110 are received in slots 112. Tubing hanger 106 is thus aligned as to its rotative position about the axis of the wellhead by pins 110 and is supported on the pins together with tubing strings 74. Holddown pins 114 are threaded into attachment 96 and are received in openings 116 formed in tubing hanger 106. Pins 114 serve to lock down tubing hanger 106 against forces tending to blow it upwardly. After the seals of the wellhead assembly have been tested through test port 102, a conventional Christmas tree (not shown) is bolted onto the top of tubing head attachment 96 to complete assembly of the wellhead.

Figures 2, 3:
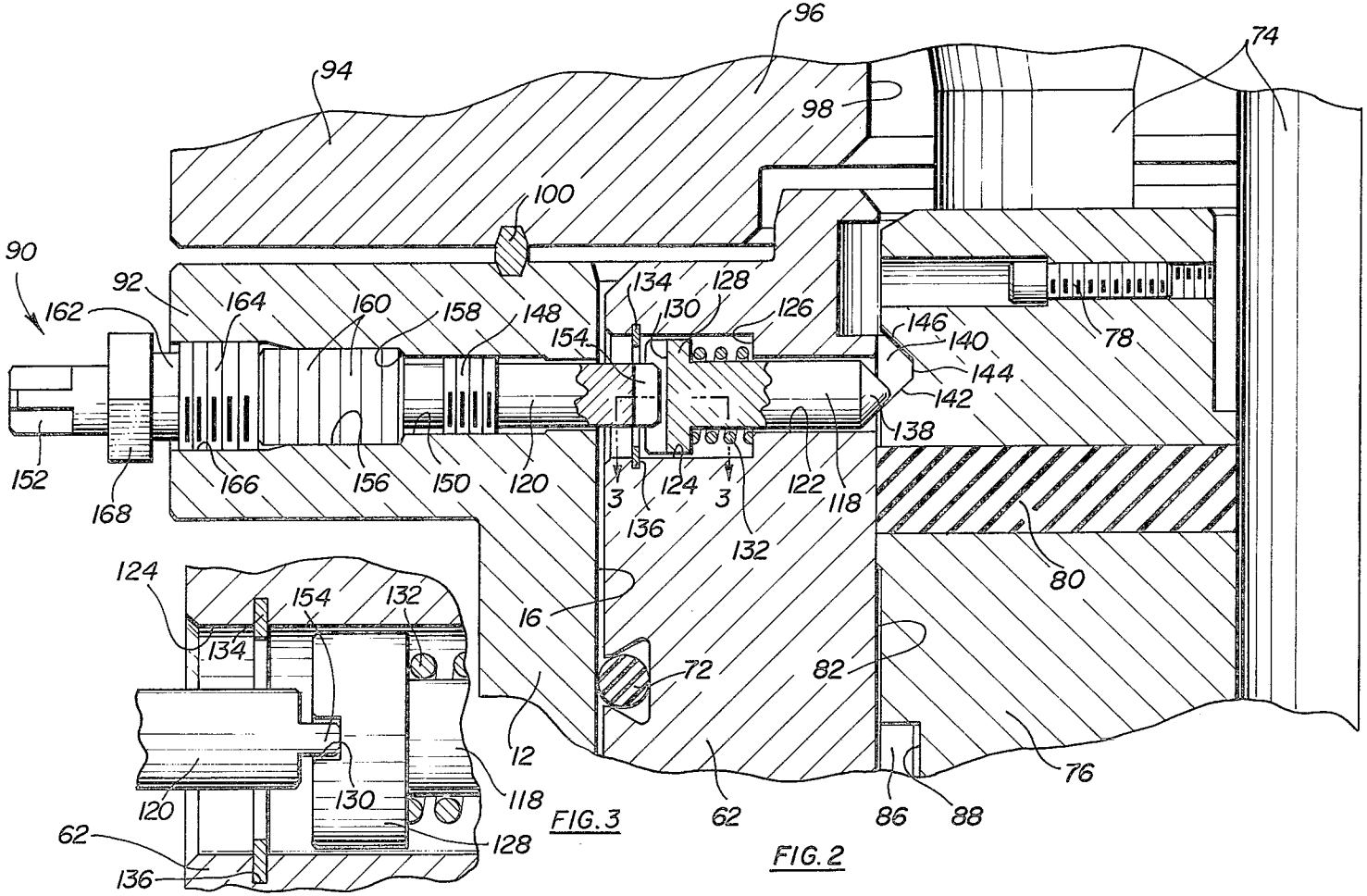
FIG. 2 is a fragmentary sectional view on an enlarged scale illustrating the holddown mechanism shown in FIG. 1.
FIG. 3 is a fragmentary sectional view on an enlarged scale taken generally along line 3—3 of FIG. 2 in the direction of the arrows.

Referring now particularly to FIGS. 2 and 3, the holddown mechanism 90 of the present invention is illustrated in detail. Mechanism 90 includes a plurality of pins 118 and associated screws 120 which cooperate with one another to hold down wraparound tubing hanger 76 and to energize seal 80. All of the pins 118 are constructed identically, as are all of the screws 120; therefore, only one pin 118 and its associated screw 120 will be described in detail, it being understood that the remainder of the pins and screws are constructed in the same fashion and function identically. It is contemplated that a typical wellhead will include five sets of pins 118 and screws 120 spaced approximately equidistantly around the circumference of the wellhead.

Each pin 118 is received for axial sliding movement in a cylindrical passage 122 extending horizontally from the outside surface of bowl 62 to the bore 82 of the bowl. Passage 122 has a diameter slightly greater than the diameter of the cylindrical shank portion of pin 118, and the shank of the pin is thus able to slide inwardly and outwardly in passage 122. Each passage 122 has an enlarged cylindrical counterbore 124 formed on its outer portion, and a flat outwardly facing shoulder 126 of annular configuration is presented at the juncture between counterbore 124 and the inner portion of passage 122. Each pin 118 has on its outer end an enlarged head 128 having a generally cylindrical shape and a size to fit within counterbore 124 for sliding movement therein. As best shown in FIG. 3, each head 128 is provided with a slot 130 in the surface of the head which faces outwardly.

Head 128 is spaced outwardly of shoulder 126, and a compression spring 132 is coiled around the shank of each pin, engaging shoulder 126 at one end and head 128 at the opposite end. Springs 132 thus act to urge pins 118 outwardly at all times. A split retainer ring 134 is fitted in a groove 136 formed in the wall of countersink 124. Each ring 134 engages head 128 of the corresponding pin in order to retain the pin within its passage 122 of bowl 62.

The inner end of each pin 118 is in the form of a tapered tip 138 having a generally frusto-conical configuration and a rounded point. Tip 138 has a size and shape to fit rather closely in a tapered groove 140 which is formed in the outer surface of tubing hanger 76 in extension completely around the circumference of the tubing hanger at a location above seal 80. Groove 140 is located inwardly of the inner end of passage 122 and has a lower frusto-conical camming surface 142 which inclines inwardly from bottom to top at substantially the same angle as the taper of tip 138. Surface 142 is located adjacent to the inner end of passage 122 such that tips 138 of pins 118 will contact surface 142 when the pins are pushed inwardly toward tubing hanger 76. Groove 140 has a relatively short cylindrical base surface 144 and a frusto-conical upper surface 146 which inclines outwardly from bottom to top. In section, groove 140 has substantially the same size and shape as tip 138.

Each screw 120 has a threaded portion of its shank as indicated at 118 which is screwed into mating internal threads of a horizontal passage 150 extending in wellhead 12 from the outside surface of flange 92 to the wellhead bore 16. Turning of screws 120 thus effects threaded axial movement of the screws into and out of the respective passages 150. Each screw 120 has a head 152 which is located exteriorly of wellhead 12 and which is formed to conveniently receive a wrench or other tool used to turn the screw.

The alignment pins 64 previously described in connection with FIG. 1 cooperate with slots 66 to assure that passages 122 of hanger bowl 62 are aligned axially with the corresponding passages 150 of wellhead 12. Accordingly, screws 120 are axially aligned with the respective pins 118. The inner end of each screw 120 has a relatively narrow blade 154 which has a size and shape to fit rather closely in the corresponding slot 130, as best shown in FIG. 3. It should be apparent that the engagement of blades 154 with the sides of slots 130 causes pins 118 to rotate in response to rotation of screws 120.

Each passage 150 has a slightly enlarged intermediate portion 156 which presents at its connection with the inner portion of the passage a generally outwardly facing shoulder 158. A set of packing includes packing rings 160 which encircle the shank of screw 120 with the innermost packing ring 160 bearing against shoulder 158. A gland nut 162 is externally threaded at 164 in order to mate with internal threads formed in an enlarged outer portion 166 of passage 150. Each gland nut 162 has a head 168 located exteriorly of wellhead 12 and formed to conveniently receive a wrench or another tool. Gland nut 162 fits around the shank of screw 12 and may be threaded tightly into portion 166 of the passage such that its inner end bears against the outermost packing ring 160, thereby compressing the packing set such that it forms a tight seal between the shank of screw 120 and passage portion 156.

During assembly of the wellhead, pins 118 are pushed outwardly by springs 132 such that tips 138 of the pins do not project inwardly far enough to significantly interfere with insertion of tubing hanger 76 into bowl 62. At the same time, retainer rings 134 maintain the pins within passages 122 of the hanger bowl 62 as the hanger bowl is being installed. Once tubing hanger 76 is in place within bowl 62, screws 120 are threaded into passages 150 with their blades 154 entering slots 130 of the respective pins 118. The outward force exerted by springs 132 on pins 118 facilitates entry of blades 154 into slots 130, in that the positive outward force provided by the springs prevents pins 118 from being pushed completely inwardly before blades 154 enter slots 130, as could occur if the pins were simply loose in passages 122. Springs 132 thus assure that the blade 154 of each screw 120 will properly enter the corresponding slot 130 in order to impart rotation to pins 118 simultaneously with their axial movement into hanger bowl 62.

Sufficient inward threading of screws 120 causes pins 118 to be pushed inwardly until their tips 138 enter groove 140 and engage camming surface 142. The camming engagement between tips 138 and surface 142 pushes tubing hanger 76 downwardly in a manner to lock it down against even the strongest forces tending to blow it upwardly with respect to hanger bowl 62. At the same time, the downward force on tubing hanger 76 radially expands seal 80 to assure that it firmly seals with bore 82 and with tubing strings 74.

The rotation imparted to each pin 118 as it is moved against surfce 142 reduces the force necessary to run the pin inwardly the required distance and at the same time prevents the pin from jamming or otherwise improperly contacting surface 142. In other words, the rotation of pin 118 serves to increase the effectiveness of the holddown mechanism and to reduce the force needed to operate it. Additionally, only minimal frictional forces must be overcome in order to run the pins inwardly against tubing hanger 76. Since pins 118 and screws 120 cooperate in pairs and are not rigidly connected with one another, the loads that are applied do not excessively bend or otherwise unduly deform or damage the components as can occur with single long screws.

If tubing strings 74 and hanger 76 are to be raised, the holddown mechanism 90 is backed off by threading each of the screws 120 outwardly. As this occurs, springs 132 push pins 118 outwardly until heads 128 are moved against the retaining rings 134. At this time, tips 138 will be substantially fully withdrawn from groove 140, and the pins do not interfere with movement of tubing hanger 76 upwardly to lift the tubing strings.

What is claimed is:

1. A wellhead assembly comprising:

a head member adapted to support at least one well casing, said head member having an axial bore and a plurality of spaced apart threaded passages extending generally horizontally from the outer surface of said head member to the bore thereof;

a hanger bowl supported in the bore of said head member and having a plurality of generally horizontal passages axially aligned with the respective passages of said head member, the passges of said hanger bowl extending from the outside surface of the bowl to a bore thereof;

a tubing hanger supported in the bore of said hanger bowl and adapted to receive at least one tubing string extending within the well casing, said tubing hanger having a groove on the outside surface thereof adjacent the inner ends of the passages in said hanger bowl, said groove presenting a camming surface located adjacent the inner ends of the passages in said hanger bowl, said camming surface being inclined from vertical and having an orientation to face generally upwardly and outwardly;

a plurality of pins received in the respective passages of said hanger bowl for axial movement therein, each pin having an outer end and an inner end providing a tapered tip extending at least partially into said groove and acting against said camming surface in camming interaction therewith to urge said tubing hanger downwardly in camming fashion;

a plurality of screw elements received in the respective passages of said head member for threaded axial movement therein, said screw elements being axially aligned with the respective pins and being accessible from the exterior of said head member to effect threaded advancement of the screw elements into the head member and against the outer ends of said pins to force said tapered tips of the pins at least partially into said groove and against said camming surface to hold down said tubing hanger.

2. A wellhead assembly as set forth in claim 1, including a head portion on the outer end of each pin and a slot in each head portion facing the inner end of the adjacent screw element, the inner end of each screw element being of a size and shape to enter the corresponding slot to translate rotation of said screw elements into rotation of said pins.

3. A wellhead assembly as set forth in claim 2, including resilient means urging each pin outwardly to facilitate entry of said inner ends of the screw elements into the respective slots.

4. A wellhead assembly as set forth in claim 3, including means for retaining said pins in the respective passages of said hanger bowl against the force of said resilient means.

5. A holddown mechanism for a tubing hanger disposed within a hanger bowl which is supported within a wellhead, said hanger bowl and wellhead having a plurality of aligned passages extending generally horizontally therein and said tubing hanger having a groove on the exterior thereof with said groove presenting a camming surface on the tubing hanger located adjacent the inner ends of the passages in said hanger bowl, said holddown mechanism comprising:

a plurality of pins received in the respective passages of said hanger bowl for axial movement therein, each pin having an outer end and an inner end presenting a tapered tip operable to enter said groove and to engage said camming surface in a manner to hold down said tubing hanger;

a plurality of screw elements threadedly received in the respective passages of said wellhead and axially aligned with the respective pins, each screw element having a head portion accessible from the exterior of the wellhead to effect threaded advancement of the screw element into the wellhead to engage an inner end of the screw element against the outer end of the corresponding pin to push the pin inwardly with the tapered tip thereof entering said groove and contacting said camming surface in camming interaction therewith to hold down the tubing hanger;

cooperating surfaces on the inner ends of said screw elements and the outer ends of said pins engageable with one another to rotate said pins in response to rotation of the respective screw elements, whereby said pins are rotated as said tapered tips thereof are moved into said grooves and against said camming surface.

6. A holddown mechanism as set forth in claim 5, including resilient means for urging said pins outwardly to facilitate engagement of said cooperating surfaces with one another.

7. A holddown mechanism as set forth in claim 6, including means for retaining said pins in the respective passages of said hanger bowl against the force of said resilient means.

8. A holddown mechanism as set forth in claim 5, wherein said cooperating surfaces comprise:

a slot in the outer end of each pin facing the inner end of the adjacent screw element; and a blade on the inner end of each screw element having a size and shape to be closely received in the adjacent slot, thereby translating rotation of each screw element into rotation of the corresponding pin.

9. A holddown mechanism as set forth in claim 5, including:

an enlarged portion of each passage in said hanger bowl, each enlarged portion terminating in a generally outwardly facing annular shoulder;

an enlarged head on the outer end of each pin disposed in the enlarged portion of the corresponding passage a spaced distance outwardly of said shoulder; and a compression spring coiled around each pin and engaging the head thereof at one end and the corresponding shoulder at the opposite end, said springs thereby urging said pins outwardly to facilitate engagement of said cooperating surfaces with one another.

10. A holddown mechanism as set forth in claim 9, including retaining means in said enlarged portions of the passages for engaging the heads of said pins in a manner to retain the pins in the passages of said hanger bowl.

* * * * *